US010689236B2

(12) United States Patent
Pearson

(10) Patent No.: US 10,689,236 B2
(45) Date of Patent: Jun. 23, 2020

(54) OPENER

(71) Applicant: Jennifer Pearson, Oakland, CA (US)

(72) Inventor: Jennifer Pearson, Oakland, CA (US)

(73) Assignee: Jen Pearson, Oakland, CA (US)

( * ) Notice: Subject to any disclaimer, the term of this patent is extended or adjusted under 35 U.S.C. 154(b) by 165 days.

(21) Appl. No.: 16/112,332

(22) Filed: Aug. 24, 2018

(65) Prior Publication Data

US 2019/0062136 A1 Feb. 28, 2019

Related U.S. Application Data

(60) Provisional application No. 62/551,980, filed on Aug. 30, 2017.

(51) Int. Cl.

| | |
|---|---|
| ***B67B 7/44*** | (2006.01) |
| ***B67B 7/40*** | (2006.01) |
| ***B67B 7/16*** | (2006.01) |

(52) U.S. Cl.
CPC ..... *B67B 7/44* (2013.01); *B67B 7/16* (2013.01); *B67B 7/403* (2013.01)

(58) Field of Classification Search
CPC ..... B67B 7/16; B67B 7/44
USPC ..... D40/33, 40, 41, 43
See application file for complete search history.

(56) References Cited

U.S. PATENT DOCUMENTS

| | | | | |
|---|---|---|---|---|
| 4,178,646 A * | 12/1979 | Swartz | B67B 7/36 | 7/156 |
| 4,660,446 A * | 4/1987 | Soltis | B67B 7/403 | 81/3.4 |
| 5,535,644 A * | 7/1996 | Paul-Alexandre | B67B 7/0411 | 81/177.4 |
| D637,465 S * | 5/2011 | Focht | D8/40 | |

* cited by examiner

*Primary Examiner* — Daniel J Colilla

(57) ABSTRACT

An opener with a rigid parallelepiped body having rhombus sides and opposite end portions for opening a bottle or a can.

15 Claims, 6 Drawing Sheets

OPENER

TECHNICAL FIELD

The present disclosure relates to opener devices for containers, and specifically, to an opener for opening capped bottles or tab-top cans.

BACKGROUND

Beverage containers, such as drink bottles or soda cans, are well known and provide reliable means for containment and delivery of liquids to consumers. A drink bottle has a hollow body for containing a volume of liquid therein, and a circular opening whereupon a bottle cap is crimp-sealed to cap the bottle. Similarly, beverage cans typically include a cylindrical body for containing liquids, and a circular opening that is sealed with a lid having a tab, whereby upon removal of the tab the liquid contained inside the can is dispensed through the opening created by the removal of the tab.

Various conventional bottle openers and can openers are available for removing bottle caps or tabs to dispense the liquid contained inside such containers. However, such devices suffer from the number of drawbacks. A primary challenge associated with existing opener devices is that they are not easy to operate due to their nonergonomic design. This problem is particularly exacerbated for user with weak muscles or poor dexterity such as seniors or younger users that have trouble in exerting force sufficient to dislodge the cap or tab.

As a result, there is a need for a bottle or can opener that is easy to operate.

Moreover, another problem associated with existing openers is that they are generally designed to remove either bottle caps or open cans, but not both. As a result, a user such as a bartender who needs to frequently open different types of beverage containers must have access to different tools for opening either type of container.

Accordingly, there is a need for a combination opener device that can be utilized to open both bottles and cans.

SUMMARY

In one example embodiment, a user opener device for opening a bottle is described. The opener comprises a rigid parallelepiped body having rhombus sides and opposite end portions favorably sized to hold a bottle cap, each end portion having a first member to engage the crown of the bottle cap and a second member to cooperate with the top surface of the bottle cap about a fulcrum axis for disengaging the cap from the mouth of the bottle upon exertion of an effort force on the opposite end portion.

In another example embodiment, an opener is disclosed. The opener has a rigid parallelepiped body having rhombus sides and opposite end portions favorably sized to hold a bottle cap, each end portion having a first member to engage the crown of the bottle cap and a second member to cooperate with the top surface of the bottle cap about a fulcrum axis for disengaging the cap from the mouth of the bottle upon exertion of an effort force on the opposite end portion of the opener; and the first member having a slot to receive a tab of the can whereby the end portion cooperates with the top surface of the can about a fulcrum axis for disengaging the tab from the top of the can upon exertion of an effort force on the opposite end portion of the opener.

In another example embodiment, an opener is described. The opener comprises a rigid parallelepiped body having rhombus sides and opposite end portions, each end portion having a first member and a second member, the first member having a slot to receive the tab whereby the end portion cooperates with the top surface of the can about a fulcrum axis for disengaging the tab from the top of the can upon exertion of an effort force on the opposite end portion of the opener.

BRIEF DESCRIPTION OF THE DRAWINGS

The accompanying drawings, which are incorporated in and constitute part of this disclosure, together with the description, illustrate and serve to explain the principles of various example embodiments herein.

DETAILED DESCRIPTION OF EXAMPLE EMBODIMENTS

Reference will now be made in detail to the example embodiments implemented according to the present disclosure, the examples of which are illustrated in the accompanying drawings. Wherever possible, the same reference numbers will be used throughout the drawings to refer to the same or like parts.

Opener devices are particularly desirable for gaining access to contents of containers. Bottle and can openers are often used to remove the crimped bottle caps or tabs respectively so as to permit the user to dispense the contents of bottles or cans.

However, the current openers are sometimes awkward to operate, particularly for users with limited dexterity or users that lack sufficient force to open bottles or cans using known openers. Also, existing openers often serve the unique function of opening either bottles or cans, but not both.

The solution herein addresses a pressing need for an opener that is easy to use particularly for users with a weak grip. The opener tool herein provides an improved grip since the operator's fingers clasp and curl inside the opener. This is particularly useful for user having difficulty with grasping. Moreover, the proposed opener reduces the travel distance for the hand that is exercising the effort force for dislodging the cap off a bottle or removing a tab.

Advantageously, the solution herein also provides for a dual can and bottle opener, thereby reducing the need for separate opener devices yet at the same time allow users to open both cans and bottles using the same device. Unlike some of the existing bottle or can openers, the present opener is operable at either end.

Embodiments of the present disclosure provide an opener device and a method for opening bottles or cans using the same opener device.

Figure 1:
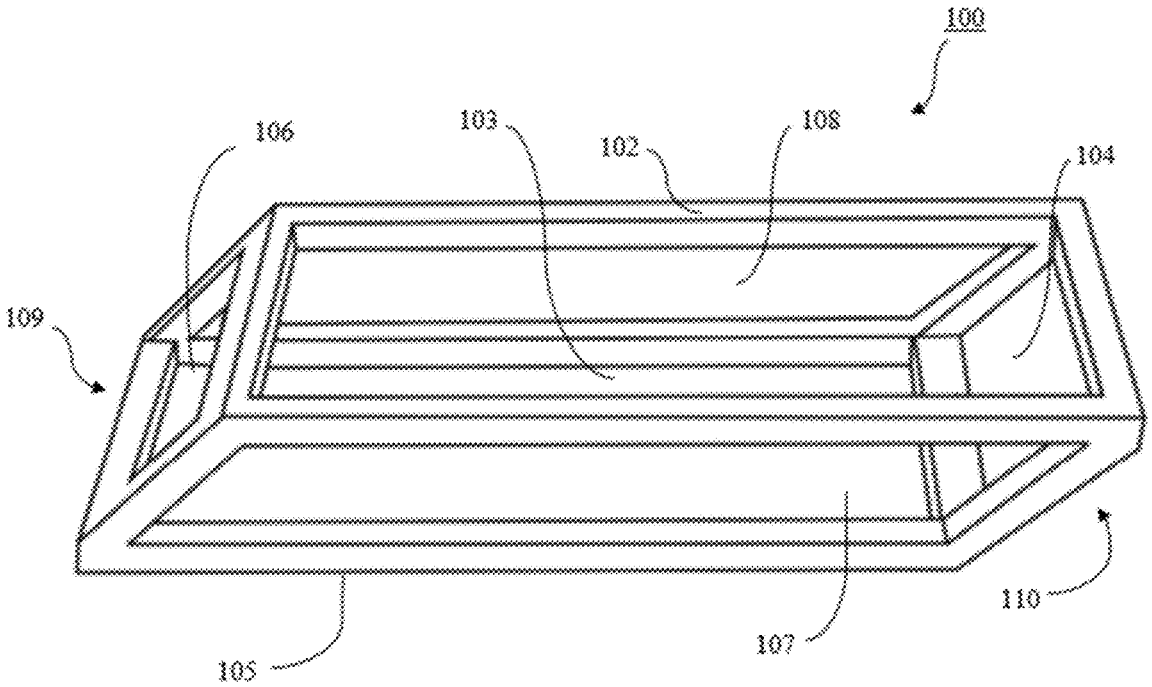
FIG. 1 is a top view of an example opener in which various implementations described herein may be practiced.

FIG. 1 illustrates a top view of an example of an opener 100 for in which various implementations as described herein may be practiced. In the presently described embodiment, the opener 100 has a rigid body 102 that includes sides 103 to 108 each corresponding to a side of the rigid body 102. The body 102 is generally made from a solid metal such as bronze, brass, or alloys, however, it can also be made from rigid plastics or similar rigid compounds. In the example embodiment presently illustrated, side 103 is on the top and side 105 is at the bottom of body 102. Likewise, side 104 is on the right and side 106 is on the left of the body 102. Side 107 is a front side and side 108 is a rear side. While the presently described embodiment includes sides 107 and 108 that are shaped as a rhombus, other generally rhombus shapes may also be contemplated by those skilled in the art. The opener 100 of FIG. 1 also has opposite end portions 109 and 110. The end portions 109 and 110 are shaped as squares in the presently described example embodiments, however, other shapes such as a rectangle can also be used. In this example embodiment, the end portion 109 is on the left side of the body 102, and the end portion 110 is on the right side of the body 102 as depicted in FIG. 1.

In the example embodiment of FIG. 1, some of the edges of sides 103 to 108 are chamfered, beveled, rounded, or softened to prevent these corners to injure the operator's fingers. Furthermore, softening the sharp corners prevents the opener 100 from causing damage to a surface such as a table top when falling off the operator's hands.

At least one of the portions 109 and 110 is favorably sized to contain a bottle cap therein as further described. Advantageously, this facilitates for the operator of the opener 100 to guide and engage a bottle's top to remove its cap. Moreover, the body 102 acts as a channel for catching the cap, thereby preventing the cap from falling on other objects and causing scratches or damages. Moreover, the operator does not have to frequently collect the removed cap off the floor, which can pose a hazard by causing the operator or another person to slide over the cap or step on the cap and get injured.

In some example embodiments, the body 102 is magnetized to prevent the cap from falling on the ground upon opening the bottle. The magnetized body 102 would attract and catch a removed cap inside or on any of the side 103 to 108 of the body 102. The operator can thereafter dislodge the cap from the body 102 of the opener 100 and safely discard the cap to prevent injury to someone who may otherwise accidentally step over a removed cap fallen on the floor.

Figure 2:
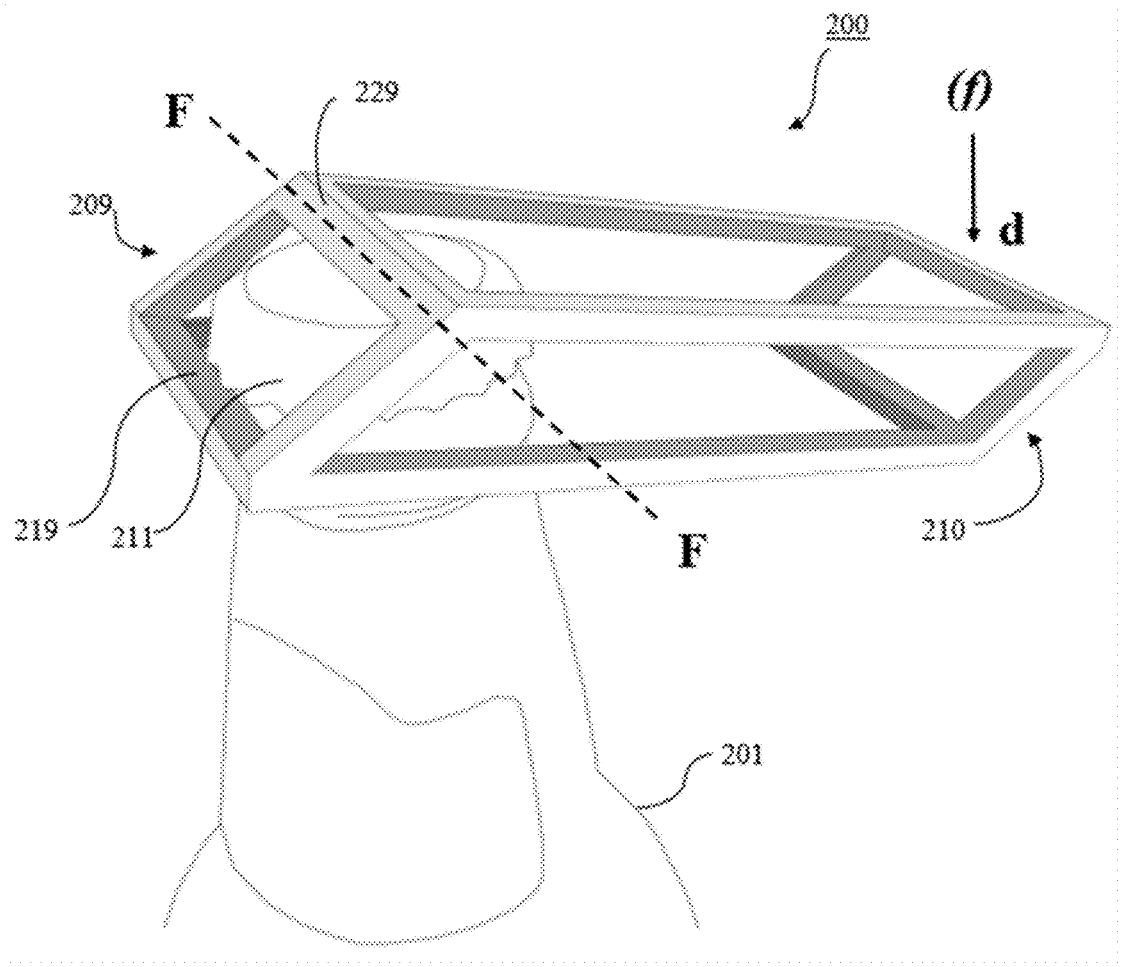
FIG. 2 is a side view of an example opener for implementing embodiments consistent with the present disclosure.

Reference is now made to FIG. 2, which illustrates an opener 200 for prying a cap off a bottle in accordance with an example embodiment. As shown in FIG. 2, the opener 200 has an end portion 209 that is sized to accommodate a cap 211 of a bottle 201. In the presently described embodiment, the bottle 201 has a crimp type tapered bottle cap 211 also known as a crown cap. The end portion 209 has a member 219 that engages the crown of the cap 211. The end portion 209 also has another member 229 that cooperates with the top surface of the cap 211 about an axis F-F. Upon exertion of an effort force (f) on an end portion 210 in the downward direction depicted by arrow d in FIG. 2, the member 229 acts as a fulcrum whereby member 219 dislodges the cap 211 off the mouth of the bottle 201, and the cap 211 is dislocated and removed from the bottle 201 to allow a user to gain access to the content of the bottle 201. Advantageously, the unique configuration of the opener 200 provides an easier leverage point to pry off the cap 211 from the bottle 201. Moreover, the operator of the opener 200 exercises an effort force over a small axis F-F to dislodge the cap 211 off the bottle 201.

In some embodiments, the member 219 includes a recessed area (not shown) to partially receive the cap 211. The recessed area is provided to substantially secure the cap 211 against the member 219 and avoid slippage of the cap 211 during the removal action. The recessed area may have notches to accommodate the crown of the cap 211. The notches would further prevent the cap 211 from sliding when the bottle 201 is being decapitated.

Figure 3:
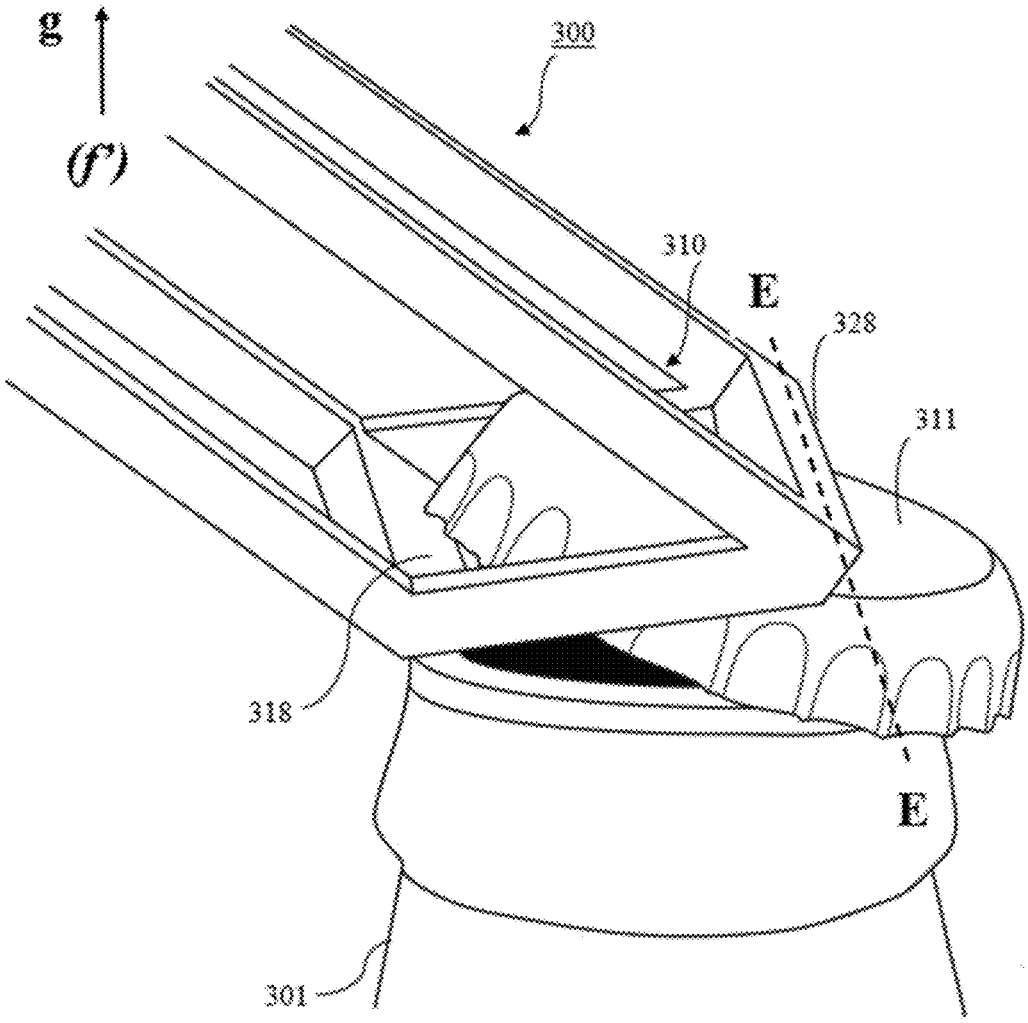
FIG. 3 is side view of an example opener for implementing embodiments consistent with the present disclosure.

Reference is now made to FIG. 3, which shows a perspective view of an opener 300 is dislodging a bottle cap according to another example embodiment of the present disclosure. As shown in FIG. 3, a mouth of a bottle 301 is inserted inside an end portion 310 of the opener 300. The end portion 310 is adapted to accommodate the mouth of the bottle 301 therein. Member 318 of the end portion 310 contacts a lip of a cap 311 and removes the cap 311 upon exertion of a force (f) in the upward direction depicted by the arrow g in FIG. 3. The force (f) causes a member 328 to pivot about an axis E-E, thereby allowing member 318 to decapitate the bottle 301 and dislocate the cap 311 from the mouth of the bottle 301.

Figure 4A:
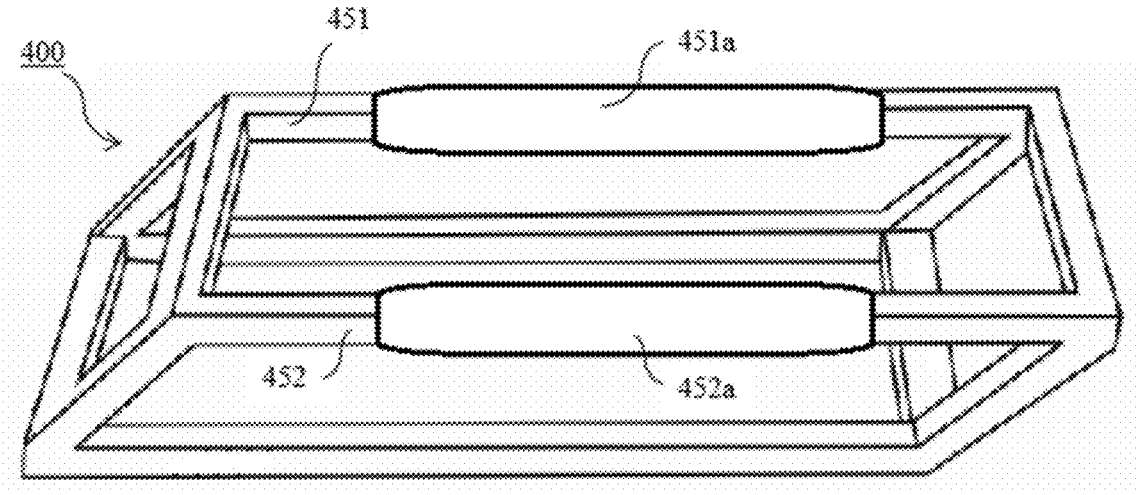
FIGS. 4A and 4B are top views of example openers in accordance with some embodiments of the present disclosure.

Referring now to FIG. 4A, a top view of an opener 400 is shown. The opener 400 includes comfort sleeves 451*a* and 452*a* that are positioned over members 451 and 452, respectively, of the opener 400. The comfort sleeves 451*a*, 452*a* allow the operator to have an improved grip when grasping the opener 400. As a result, the opener 400 is less likely to slip through the fingers of the operator in operation. In some embodiments, the comfort sleeves 451*a*, 452*a* are made from soft padding materials including gel, foam, leather, or the like to improve comfort for the operator when applying an opening force on the opener 400. It is understood that the comfort sleeves 451*a*, 452*a* are not limited to members 451, 452. Similar comfort grips may also be provided on other members of the opener 400 to improve comfort or grip of the opener 400.

Figure 4B:
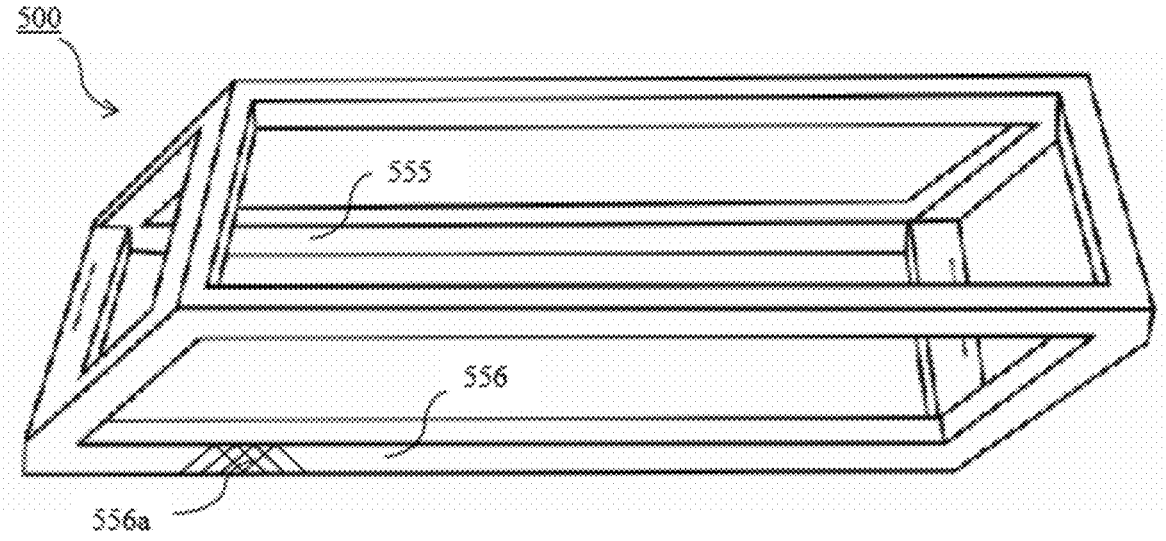

FIG. 4B shows a top view of an opener 500 according to yet other example embodiments of the present disclosure. The opener 500 of FIG. 4B includes grip marks 556*a* on a member 566 to permit the user to better grasp the opener 500 during use. Similar grip marks (not shown) are also provided on a member 555. These grip marks 556*a* may be serrations, stripes, indentations, notches, etch marks, or the like in various patterns.

Figure 5:
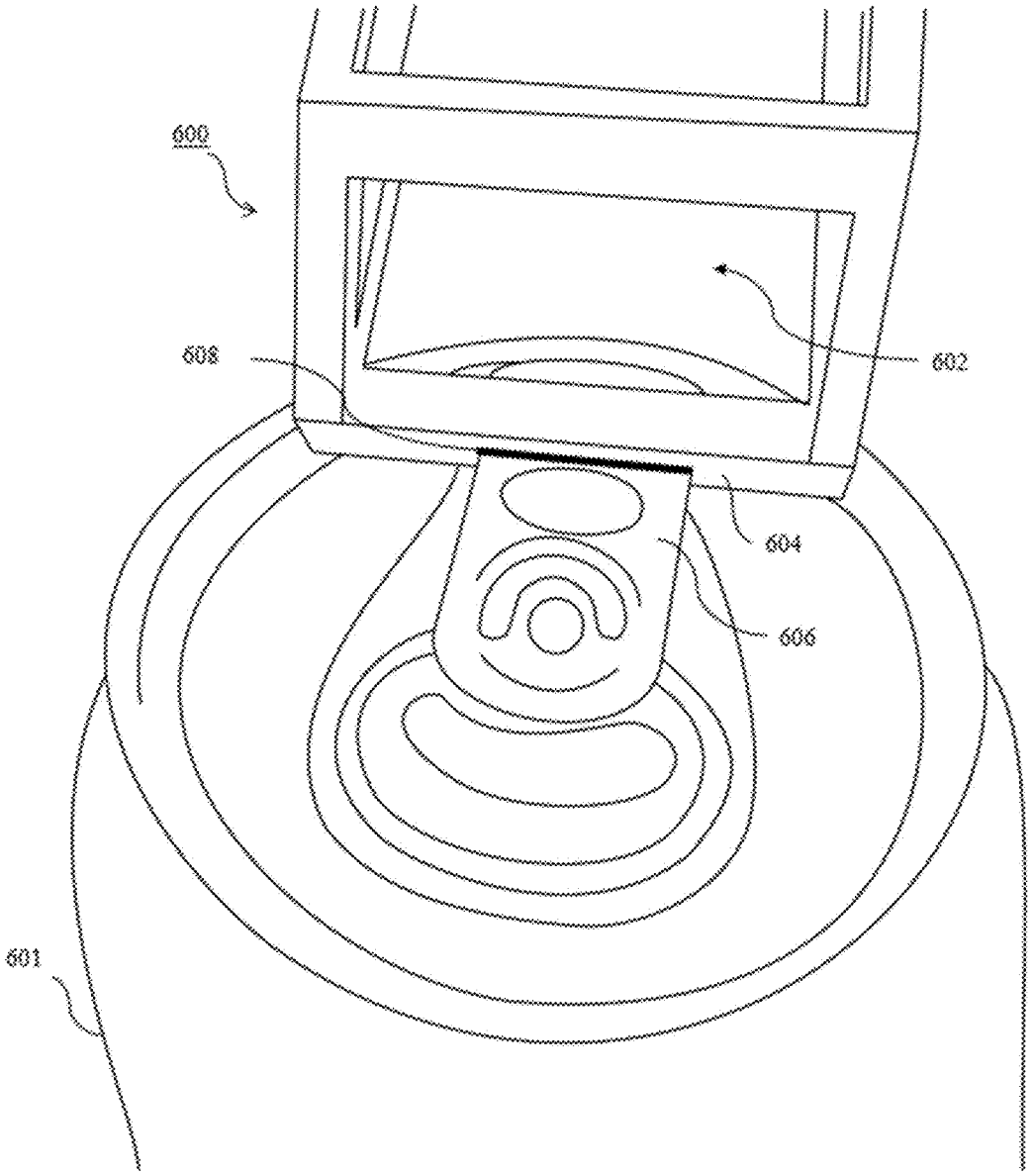
FIG. 5 is a top view of yet other examples openers in accordance with the embodiments of the present disclosure.

FIG. 5 shows a top view of an opener 600 according to an example embodiment of this disclosure. The opener 600 permits the operator of the opener 600 to remove a tap 606 from a can 601. For example, the can 601 may contain a liquid such as water, soda, beverage, oil, or the like. As shown in FIG. 5, an end portion 602 of the opener 600 has a first member 604 that cooperates with a tap 606 by a slot 608. The slot 608 is sized such that it can at least partially receive the tap 606 therein. Upon inserting the tap 606 in the slot 608, the user can exercise a force at the opposite end (not shown) of the opener 600 to dislocate the tap 606. The slot 608 can be provisioned on the first member 604 at a width than is substantially large so as to accommodate the tap 606. In some example embodiments, the slot 608 is provided only on the first member 604, however, in other embodiments, the slot 608 can be provided on the first member 604 and the opposite second member (not shown), or only on the second member of the opener 600.

Accordingly, as shown in FIG. 5, the end portion 602 of the opener 600 with a first member 604 receives at least an end portion of the tap 606 inside its slot 608. The tab 606 can be inserted inside the slot 608 and by movement of an opposite end portion (not shown) of the opener 600 in upward or downward direction. Thereafter, when the user of the opener 600 applies a force in a different direction upon the opposite end portion of the opener 600, the user can dislocate or remove the tab 606 from the can 601 thereby allowing the user to gain access to the contents of the can 601.

Figure 6:
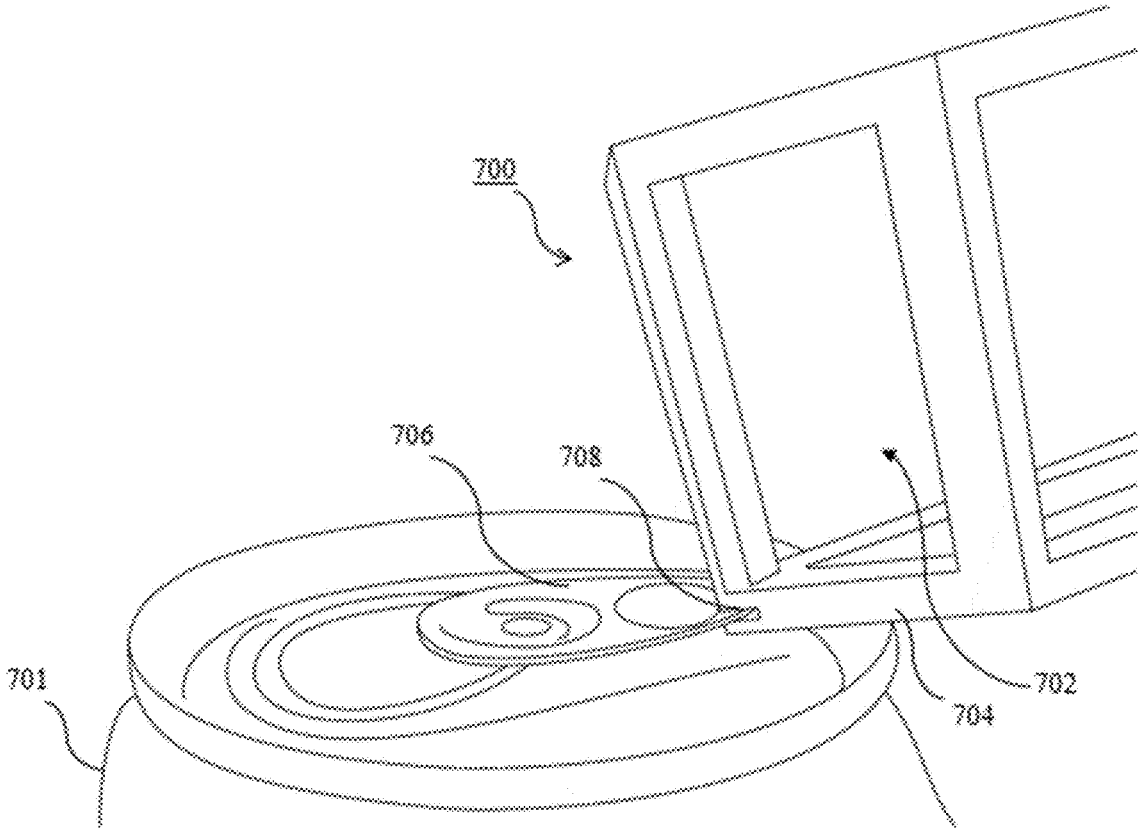
FIG. 6 is a top view of another opener according to another example embodiments of the present disclosure.

FIG. 6 shows a side view of an opener 700 according to an example embodiment of the disclosure. A part of an end portion 702 of the opener 700 has a first member 704 that cooperates with a tap 706 of a can 701 by a groove 708 provisioned on a front lip of the first member 704. The end portion 702 cooperates with the tab 706 by placing a front side of the tap 706 in the groove 708. As shown in the FIG. 6, the groove 708 has a semi-oval shape that is sized to receive the tap 706 therein, however, other shapes such as a semicircle shape, parallelogram shape, etc. that can also be machined on the first member 704.

The operator of the opener 700 can place a force upon the opener 700 in a direction to dislodge, dislocate, or remove the tab 706 from the can 701. As a result, the operator or another user can have access to the contents of the can 701 through the inlet that was blocked by the tab 706 prior to be removed or displaced by the operator of the opener 700.

In the preceding disclosure, various example embodiments have been described with reference to the accompanying drawings. It will, however, be evident to those skilled in the art that modifications or changes may be made thereto, and additional embodiments may be implemented, without departing from the broader scope of the disclosure as set forth in the claims that follow and their equivalents. For example, some of the steps of the method can be performed by a server in communication with the user device, or by endpoint devices coupled to the server or the user device. The disclosure and drawings are accordingly to be regarded in an illustrative rather than restrictive sense.

What is claimed is:

1. An opener comprising:

a rigid, parallelepiped body having rhombus sides and two end portions at opposite ends of the rigid, parallelepiped body, wherein each end portion is favorably sized to hold a bottle cap, and each end portion has a first member configured to engage a crown of the bottle cap and a second member configured to cooperate with a top surface of the bottle cap, wherein the opener is configured to remove a bottle cap from a bottle by engaging the first member of a first end portion of the two end portions with a crown of the bottle cap and engaging the second member of the first end portion with a top surface of the bottle cap about a fulcrum axis for disengaging the cap from a mouth of the bottle upon exertion of an effort force on the end portion opposite the first end portion.

2. The opener as set forth in claim 1, wherein the opener body is made from at least a rigid alloy or a rigid compound.

3. The opener as set forth in claim 1, wherein at least an edge of the opener is one of chamfered, beveled, rounded, or softened.

4. The opener as set forth in claim 1, wherein the opener body is magnetized.

5. The opener as set forth in claim 1, wherein at least one of the opener sides is covered by a comfort sleeve.

6. The opener as set forth in claim 5, wherein the comfort sleeve is made from a soft material selected from gel, foam, and leather.

7. The opener as set forth in claim 1, wherein the opener further comprises a slot at least in the first member of at least one of the two end portions.

8. The opener as set forth in claim 7, wherein the slot is sized to at least partially receive a tab.

9. The opener as set forth in claim 8, wherein a width of the slot is larger than the tab.

10. An opener for removing a bottle cap or a tab off a can, the opener comprising:

a rigid parallelepiped body having rhombus sides and two end portions at opposite ends of the rigid, parallelepiped body, wherein each end portion is favorably sized to hold the bottle cap, and each end portion has a first member configured to engage a crown of the bottle cap and a second member configured to cooperate with a top surface of the bottle cap, wherein the opener is configured to remove the bottle cap from a bottle by engaging the first member of a first end portion of the two end portions with a crown of the bottle cap and engaging the second member of the first end portion with a top surface of the bottle cap about a fulcrum axis for disengaging the cap from a mouth of the bottle upon exertion of an effort force on the end portion opposite the first end portion of the opener; and wherein the first member of the first end portion has a slot configured to receive a tab of the can whereby the first end portion is configured to cooperate with a top surface of the can about a fulcrum axis and is configured to disengage the tab from the top surface of the can upon exertion of an effort force on the end portion opposite the first end portion of the opener.

11. The opener as set forth in claim 10, wherein the opener body is made from at least a rigid alloy or a rigid compound.

12. The opener as set forth in claim 10, wherein at least an edge of the opener is one of chamfered, beveled, rounded, or softened.

13. The opener as set forth in claim 10, wherein the opener body is magnetized.

14. The opener as set forth in claim 10, wherein at least one of the opener sides is covered by a comfort sleeve.

15. The opener as set forth in claim 14, wherein the comfort sleeve is made from a soft material selected from gel, foam, and leather.

* * * * *